US005588650A

United States Patent [19]

Eman et al.

[11] Patent Number: 5,588,650

[45] Date of Patent: Dec. 31, 1996

[54] AUTOMATED INTERACTIVE ROULETTE WITH PROGRESSIVE JACKPOT

[76] Inventors: Richard G. Eman, Wilhelminastraat 24; Luis E. Mansur, Bachstraat 5, both of Oranjestad, Aruba

[21] Appl. No.: 504,236

[22] Filed: Jul. 19, 1995

[51] Int. Cl.[6] ..... A63F 5/00

[52] U.S. Cl. ..... 273/142 B; 273/142 F; 463/17; 463/25; 463/26

[58] Field of Search ..... 273/142 R, 142 B, 273/142 E, 142 F; 463/17, 23, 25, 26, 27

[56] References Cited

U.S. PATENT DOCUMENTS

| | | | |
|---|---|---|---|
| 3,819,186 | 6/1974 | Hinterstocker | 463/17 |
| 4,396,193 | 8/1983 | Reinhardt et al. | 273/142 B X |
| 4,732,385 | 3/1988 | Castellanos | 273/142 B |
| 4,869,505 | 9/1989 | Manabe | 273/142 R |
| 5,042,810 | 8/1991 | Williams | 463/17 |

*Primary Examiner*—William H. Grieb
*Attorney, Agent, or Firm*—Robert M. Downey, P.A.

[57] ABSTRACT

An automated roulette device is provided with a central processor and at least one player console having interactive controls and visual displays for placing bets and controlling the speed and moment of release of a ball from a launching mechanism onto a spinning roulette wheel. Wagering credits are calculated from cash deposited through a bill validator mechanism, as well as winning bets throughout play, as determined by the central processor. Additional bets can be placed on a jackpot, the winning of which is determined by a random generator. Upon terminating play by actuating a cash-out control on the player console, a printer dispenses a receipt having a redemption value equal to the remaining wagering credit available upon termination of play.

15 Claims, 5 Drawing Sheets

AUTOMATED INTERACTIVE ROULETTE WITH PROGRESSIVE JACKPOT

BACKGROUND OF THE INVENTION

1. Field of the Invention

This invention relates generally to gaming devices, and specifically to an automated roulette game which provides interaction of play of the game as well as a jackpot.

2. Background of the Invention

Roulette is an extremely popular gambling game which is played in virtually all casinos throughout the world. Casino roulette generally employs a table into which a radially compartmented wheel is mounted. The compartments are each assigned to a separate number, generally between one and thirty-six. These compartments are equally divided between two colors, usually red and black. There are usually one or two additional compartments, 0 and 00, which are assigned a third color. Also on the table is a layout consisting of an arrangement of the numbers corresponding to the compartments. Wagers are made generally by placing markers or cash on a spot on the layout corresponding to a compartment. The arrangement is configured to allow betting on either individual numbers, various combinations of two, three, four, five, six, twelve, or eighteen numbers, as well as odd/even numbers and either of the colors. A column bet of 12 numbers can also be bet. Each of the various combinations carries specific odds. Any number of players may bet, playing against the "bank."

To begin play, an operator calls for bets and spins the wheel in one direction as a ball is rolled in the opposite direction within a track surrounding the wheel. As the wheel is spinning, the players make bets on which compartment into which the ball will settle. As the speed of the ball slows, the operator announces that betting is closed, after which no further bets may be placed.

Once the ball settles into a particular compartment, the operator must determine which bets are winners and which are losers, which is not an easy task considering the multitude of betting combinations that are available. In addition, the operator must determine what the payout is for each winning bet and make the payouts, again a daunting task. Finally, the challenge is to make these determinations quickly enough to keep play moving along at a brisk pace, a challenge which could easily lead to errors, especially among inexperienced or fatigued operators. Thus, there is a need for a better means of determining winning bets and the appropriate payouts, both the increase the rate of play and decrease the possibility of error.

In addition, there is a need for a roulette game which can be operated automatically, to reduce the expense of hiring and training skilled operators.

In addition, if players were permitted more interaction, they would be more interested in the game, and would therefore play more often and for longer periods. Thus, there is a need for a roulette game that permits the players to actively participate in the game by, for instance, controlling the launching of the ball onto the spinning roulette wheel.

In addition, players would be kept more interested in the game if there were a chance to make a side bet on a progressive jackpot. Thus, there is a need for a roulette game which provides such a progressive jackpot side bet.

SUMMARY OF THE INVENTION

The present invention fulfills the need in the art. Broadly described, the present invention provides an automated, interactive roulette game with a progressive jackpot, for use with a rotatable roulette wheel within which a roulette ball is set into relative motion for each spin, the outcome of each spin being into which of a plurality of designated ball receptor zones in the wheel the ball settles.

The preferred embodiment of the present invention provides a wheel control means operated by a central processor for controlling the rotation of the roulette wheel; a ball launching mechanism for releasing the ball into the roulette wheel for each spin; and detection means on the roulette wheel for monitoring the position of the roulette ball relative to the ball receptor zones. An automatic ball return mechanism is provided for resetting the ball for release by the ball launching mechanism at the completion of each spin. The processor is interconnected to the roulette wheel, the ball launching mechanism and the detection means for receiving input from the detection means and determining the outcome of each spin. Play display means is interconnected with the processor indicating the outcome of each spin as determined by the processor. A player console is interconnected to the processor from which a player enters wagers on the outcome of each spin. The player console provides .cash input means, which may include a bill validator, for reception of money, wherein the processor translates the money into units of wagering credit. The processor also monitors and adjusts current credit available to the player based upon money received and wager results. Credit display means displays the current credit available as determined by the processor as well as any amount of credit currently being wagered. Bet input means is provided for inputting the wagers, only in amounts not exceeding the current credit available, into the processor prior to the ball's settling into one of the pockets. Bet display means is provided for displaying the wagers as input. Ball launch control means, interconnected to the processor, allows the player to control the time of release of the ball by the ball launching mechanism into the roulette wheel and control the ball's relative velocity at its release into the roulette wheel. Cash-out means is provided for terminating player participation and printing credit receipts in the amount of the current credit available, including winning in-play bets. More specifically, a printer prints the credit receipts in the amount of the current credit available which includes any winnings from successful bets. A cash-out key is depressed to terminated player participation, activate the printer, and zero the current credit available. The processor compares the wagers to the outcome in order to determine which of the wagers are winning, and the processor determines an appropriate payout for each winning wager. For each wager that is determined to be winning, the processor adds an appropriate amount to the current credit available. The amount of each wager which is not determined to be a winning is subtracted by the processor from the current credit available.

Bet gate means can be provided for determining and indicating when bets may be input based upon predetermined criteria. In the preferred embodiment, sensors are provided on the roulette wheel and interconnected to the processor for monitoring the speed of the ball when in play, and the bet gate means will only allow bets to be input when the sensors indicate that the ball is in play and traveling above a predetermined speed.

In the preferred embodiment, a jackpot bet means is provided by which the player can participate in a bet on a jackpot for each of the spins provided the player has entered a roulette wager on the spin. A jackpot generator randomly generates a series of elements for each of the spins, and the processor compares the series of elements to predetermined parameters to determine whether and in what amount the jackpot pays out. When it is determined that the jackpot pays out, the processor adds an appropriate amount to the current credit available for the player participating in the bet on the jackpot; when it is determined that the jackpot does not pay out, the processor subtracts a predetermined amount from the current credit available for the player participating in the bet on the jackpot. The jackpot can be progressive, meaning that the prize money increases as more bets are placed on the jackpot. Alternatively, the jackpot can be a fixed amount of money which remains constant.

In the preferred embodiment, the bet input means provides a panel having a plurality of betting keys, each of the betting keys representing one of a plurality of wagering selections or combinations. Each depression of one of the betting keys indicates a single wager of a predetermined value on the particular of the wagering selections or combinations represented by the betting key. Also provided is a reset key for canceling bets. The bet display means resembles the bet input means and has a plurality of betting displays. Each of the betting displays represents one of the wagering selections and combinations, and each unit wagered is indicated on the particular of the betting displays representing the wagering selection or combination selected. A units display can be provided for displaying the value of each wagering unit.

In the preferred embodiment, the wheel control means is controlled randomly within predetermined parameters by the processing means. Also, the ball launch control means provides a plurality of speed selection buttons, wherein depressing one of the speed selection buttons determines the ball's relative velocity at its release into the roulette wheel, and a release button, wherein depressing the release button initiates the release of the ball by the ball launching mechanism. An automatic release mechanism initiates the release of the ball whenever the release button is not depressed within a predetermined period of time.

In the preferred embodiment, the play display means comprises a table having a plurality of indicator lights corresponding to the ball receptor zones wherein each the of the indicator lights illuminates when the ball is adjacent its corresponding ball receptor zone. One of the indicator light flashes when the ball settles into its corresponding ball receptor zone.

Accordingly, it is an object of the present invention to provide an automated roulette game which provides interaction as well as an additional jackpot on which to wager.

It is an object of the invention to provide a roulette game in which a player may insert money, place bets on each spin of the wheel, in turn release the ball, and cash out at the completion of play, all without the assistance of any casino employees.

It is a further object of the invention to provide a roulette game having an interactive option for dictating the speed and time of release of the ball into the wheel.

It is a further object of the invention to provide a mechanism for use with a roulette game for allowing the players to determine the conditions of release of the ball.

It is a further object of the invention to provide a progressive jackpot game in conjunction with a roulette game.

It is a further object of the invention to provide a credit accounting mechanism for an automated roulette game and including a cash-out printer for printing a receipt for value based on a players winnings and/or remaining credit.

These and other objects, features, and advantages of the present invention may be more clearly understood and appreciated from a review of the following detailed description of the disclosed embodiment and by reference to the appended drawings and claims.

DETAILED DESCRIPTION OF THE PREFERRED EMBODIMENT

Figure 1:
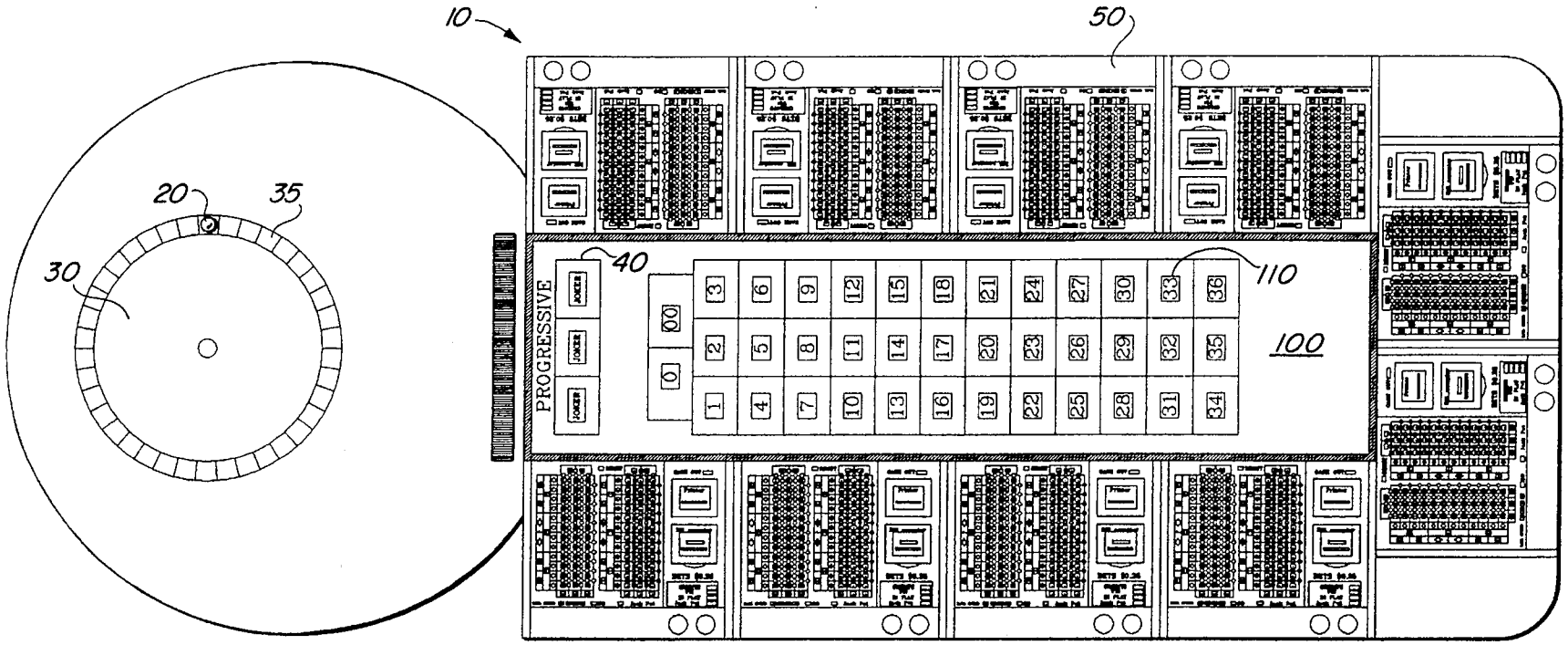
FIG. 1 is a pictorial illustration of the preferred embodiment of the invention.

Referring now to the drawings, in which like numerals indicate like elements throughout the several views, FIG. 1 illustrates the automated jackpot interactive roulette device 10 of the present invention. The winning number in each play is determined by a ball 20 which is released into an annular track about a spinning roulette wheel 30 and falls into one of the numbered and colored pockets or ball receptor zones 35 on the wheel 30. Either the ball 20 or the wheel 30, or both, may be video simulations or actual physical bodies. Therefore, any discussion herein of the ball 20 or wheel 30, and any components thereof (such as the pockets 35), shall apply to video simulations as well as actual physical devices. The ball 20 is released, recovered and reset automatically.

The betting on the various numbers, colors, or combination is done from a plurality of consoles 50 from which each player plays. The players may also choose to participate in betting on the jackpot, or progressive pot, on each spin of the wheel 30.

The players do not bet with chips, as in conventional casino roulette. Instead, betting is done through the consoles 50 by pressing designated keys on a panel, as discussed later. At each console 50, a player may insert money, place bets on each spin of the wheel, in turn release the ball 20, and cash out at the completion of play, all without the assistance of any casino employees.

The player's consoles 50 and the wheel 30 are placed around a table 100. On this table 100 are numbered blocks 110 corresponding to each pocket or ball receptor zone 35 on the wheel 30. During the spin of the ball 20, the blocks 110 will individually illuminate as the ball 20 passes over or adjacent to its corresponding pocket 35 on the wheel 30. When the ball 20 settles into a particular pocket 35, the corresponding block 110 on the table 100 will flash to indicate the winning number. The jackpot display 40 displays the amount of money in the jackpot and the combinations generated by the jackpot random generator (not shown in this figure).

Figure 2:
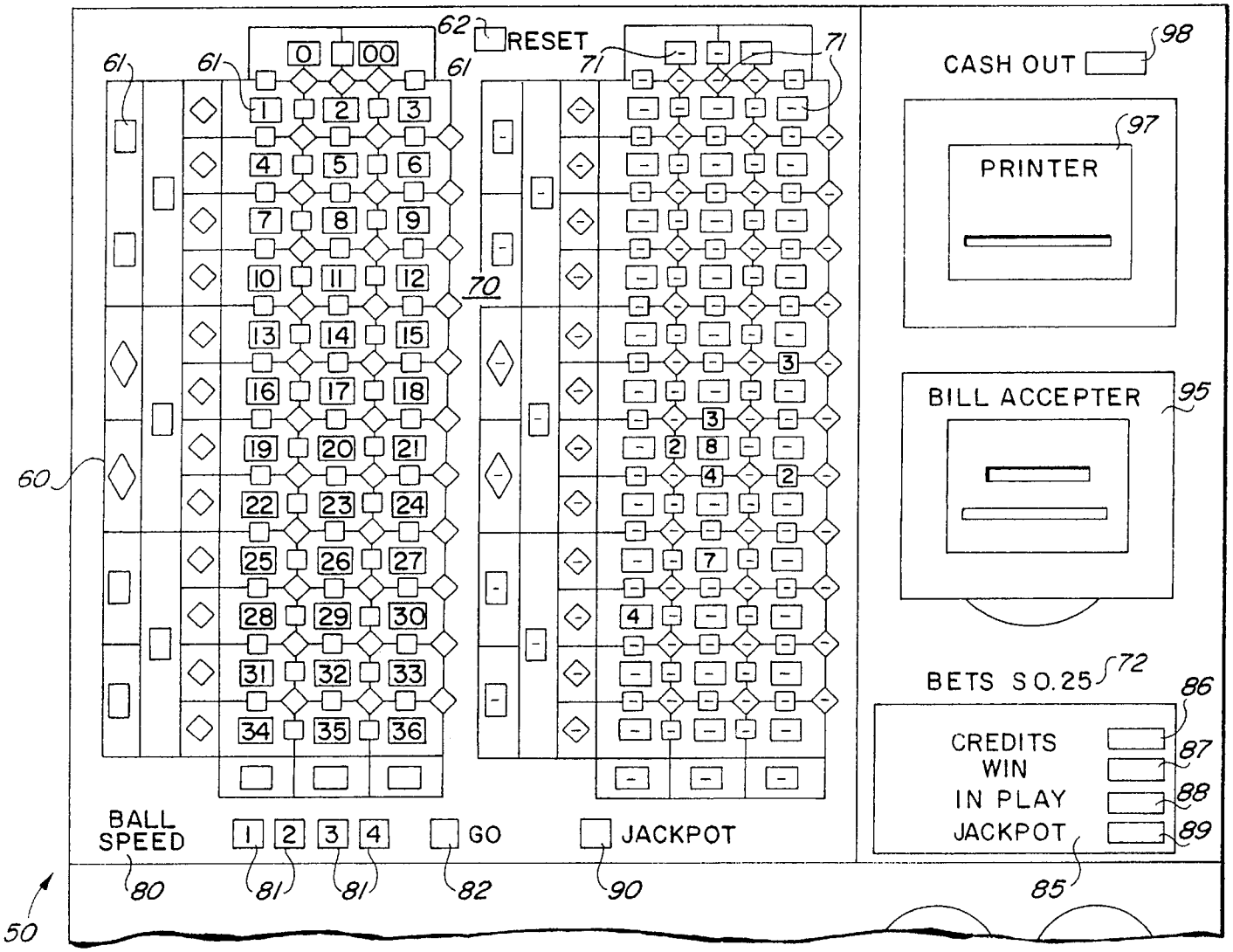
FIG. 2 is a detailed pictorial illustration of the player console portion of the preferred embodiment of the present invention.

FIG. 2 illustrates one of the player consoles 50 on which each player participates. On the console 50, there is a bet input panel 60, a bet display panel 70, an interactive panel 80 for dictating the speed and time of release of the ball 20 into the wheel 30, a credit display panel 85, a jackpot bet key 90, a cash acceptance mechanism 95, and a cash-out mechanism 97. Each of these elements will be discussed in more detail below.

Each console 50 has a bet input panel 60, which provides individual keys 61 for placing bets. The keys 61 themselves may be mechanical, electronic, or otherwise, and may be activated by any of a number of means such as pressure, thermal, or electrical stimulation. The keys 61 correspond to individual numbers and colors on the wheel 30, as well as various combinations of numbers and colors. Each depression of a key 61 will enter a single wager of predetermined units of credit on the particular number, color, or combination represented by the key 61. The value of credit units is predetermined and displayed in the unit display 72. Each such wager will result in a corresponding debit to the player's account.

If a player wishes to change or cancel a wager, all bets currently in play can be canceled by depressing the reset button 62. When this button 62 is depressed, all current bets are canceled, and the amount wagered is credited back to the player's total. During play, if a number, color, or combination chosen by a player wins, then that particular wager will remain in force for the next spin unless the player hits the reset button 62. All losing bets are automatically reset.

All best must be placed before the lockout mechanism activates. This mechanism will automatically activate as speed of the ball 20 falls below a predetermined level. The speed can be monitored by any well-known means, for instance, optical sensors placed at regular intervals on the wheel 30 to detect the passing of the ball 20. Upon completion of a spin, the appropriate amounts are debited and credited to each player's total depending upon the outcome of his or her wagers.

Also on the console 50 is a bet display panel 70, which is similar in appearance to the bet input panel 60. Instead of keys, this panel 70 provides individual displays 71, corresponding in the same manner as the keys 61 on the bet input panel 60 to individual numbers and colors on the wheel 30, as well as various combinations of numbers and colors. Each individual display 71 will indicate the number of units wagered on that corresponding number, color, or combination.

The console 50 also provides an interactive panel 80 for dictating the speed and time of release of the ball 20 into the wheel 30. This panel 80 is not used on each spin of the wheel 30, but players take turns releasing the ball 20 based upon a predetermined pattern. When it is a particular player's turn to release the ball 20, the interactive panel 80 will illuminate. The panel 80 provides a plurality of speed selection buttons 81, each corresponding to a different speed, and a release button 82. Depressing one of the speed selection buttons 81 determines the speed at which the ball 20 will be traveling at release, and depressing the release button determines the moment of release. An automatic release mechanism is provided for releasing the ball 20 should the release button 82 not be activated within a predetermined period of time.

The credit display panel 85 provides individual displays 86, 87, 88, 89 to indicate the total credit available (86), the amount won on the preceding spin (87), the amount currently in play (88), and whether the player has entered the jackpot wager (89). The credit display panel 85 can be configured to display credits in either units or actual value.

A player may bet on the jackpot by activating the jackpot bet key 90. This key 90 can only be activated in conjunction with a roulette bet. Each time the ball 20 is released, a random generator (not shown in this figure) is activated and generates a combination, which is displayed at the jackpot display 40 (FIG. 1). Winning combinations are predetermined. Certain individual combinations can pay out at certain percentages of the total jackpot, which can be either predetermined or progressive, based upon play turnover at the roulette game 10. Whether a player wins the jackpot depends upon three factors: one, the player has bet on the jackpot; two, the jackpot generator generates a winning combination; and three, the player has also bet on predetermined winning numbers in his or her roulette wager.

The cash acceptance mechanism 95 will generally be a bill validator, a device commonly found in many vending machines. Upon insertion of paper money into the mechanism 95, the player's credit total will be credited in the proper amount, as reflected at the credit display panel 85. The cash-out mechanism 97 is activated by depressing the cash-out key 98. When the player wants to terminate play and cash out, key 98 is activated. Cash-out mechanism 97 will print a ticket indicating the amount of total credit held by the player. The player can cash the ticket in at a central cashier. Activating key 98 will also reset the bets in play as well as the total credits at the console 50.

Figure 3:
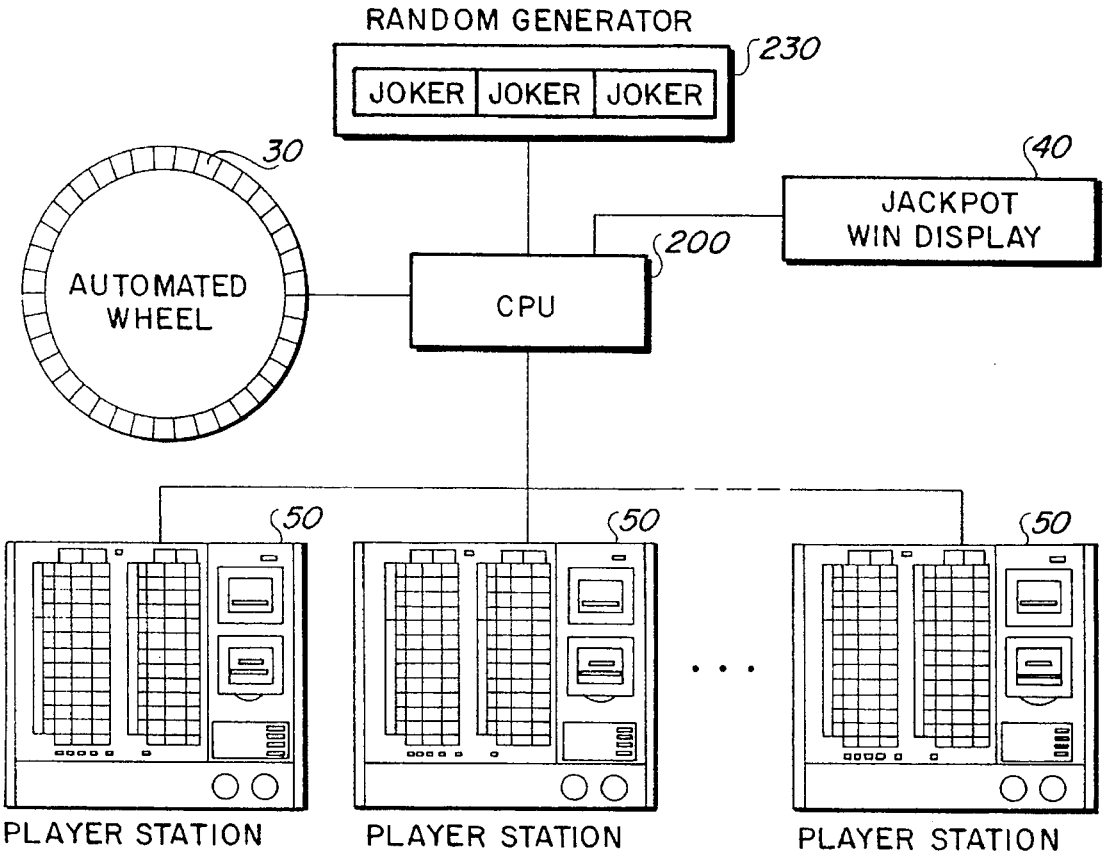
FIG. 3 is a schematic representation of the system of the preferred embodiment of the present invention.

Turning to schematic FIG. 3, all of the table activities are monitored by a central processor 200. The processor 200 registers all table activities, all activities of each player, regulates games, controls wheel mechanisms, and the like. In addition, a remote processor (not shown) can serve as a backup and as a terminal for inputting programming changes such as changing betting units.

Figure 6:
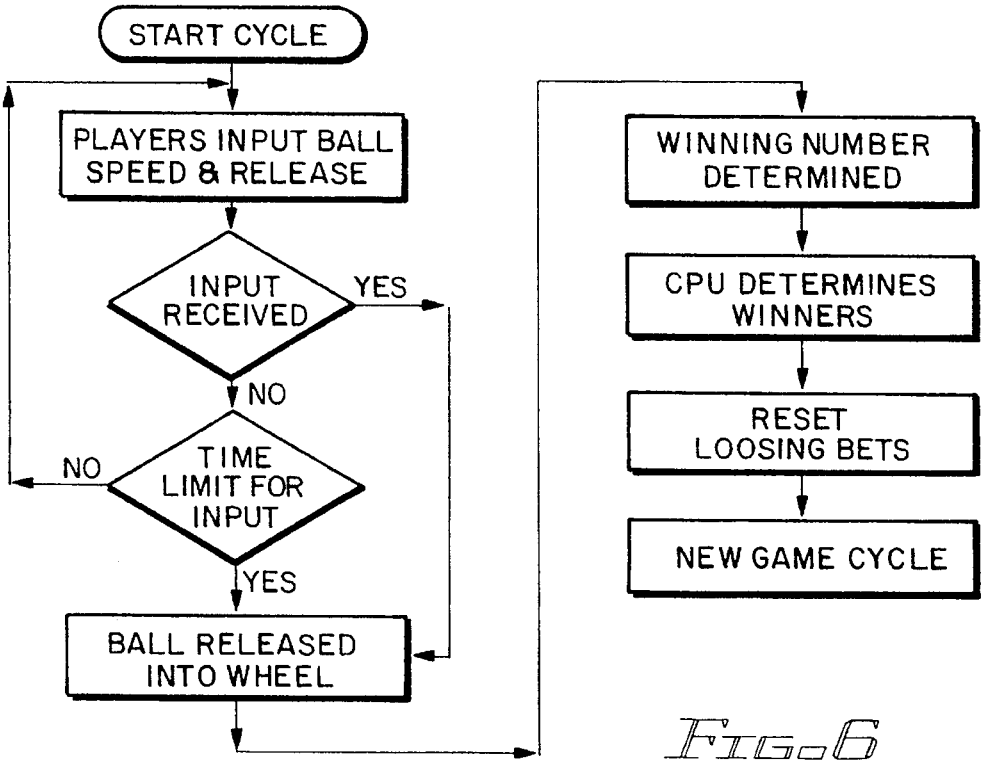
FIG. 6 is a schematic block diagram illustrating the processing and controlling of the interactive ball release mechanism of the roulette game.
Figure 4:
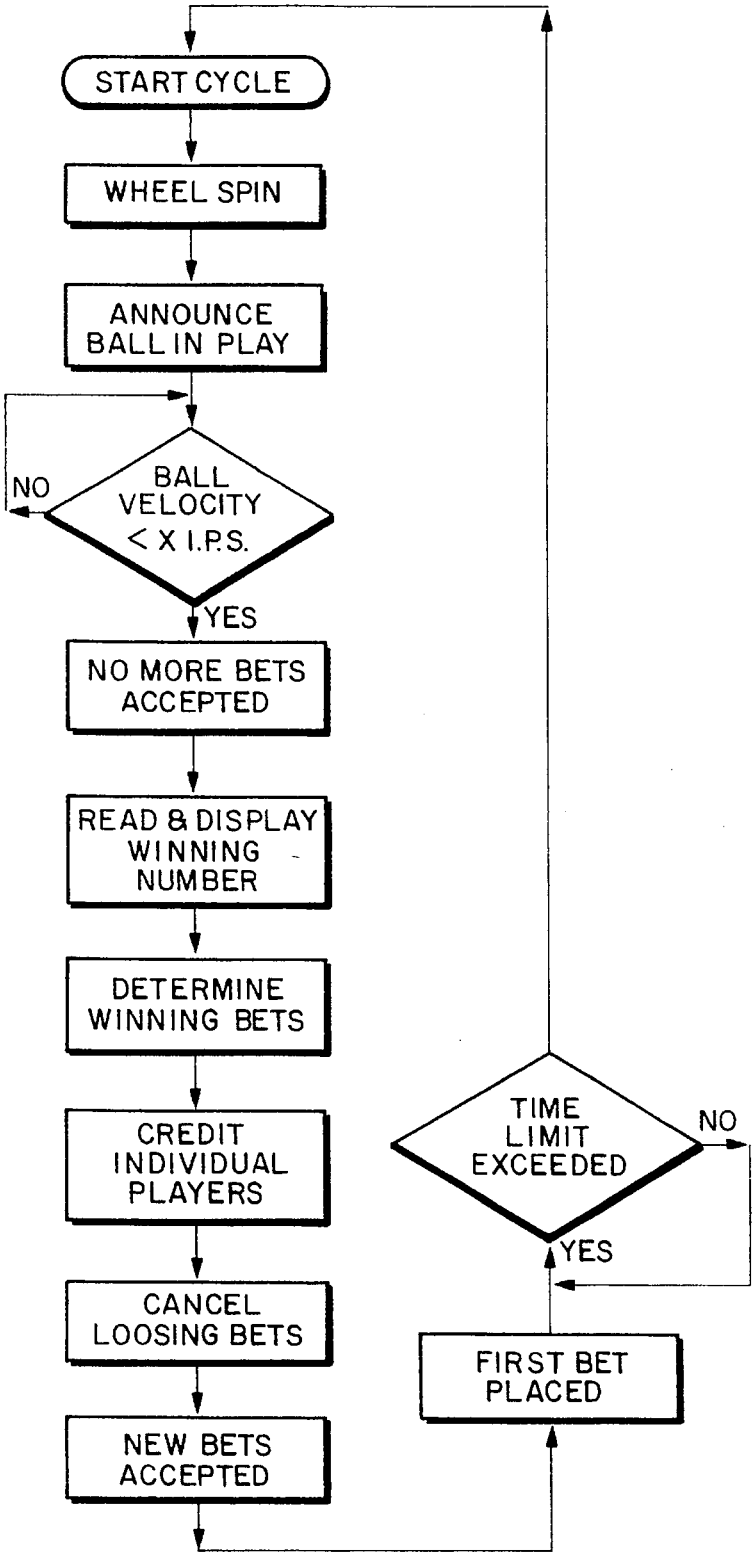
FIG. 4 is a schematic block diagram illustrating the processing and controlling of the roulette game portion of the invention.
Figure 7:
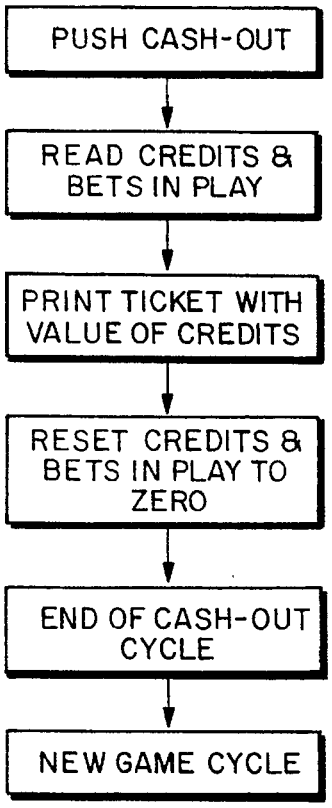
FIG. 7 is a schematic block diagram illustrating the processing and controlling of the cash-out process of the present invention.
Figure 5:
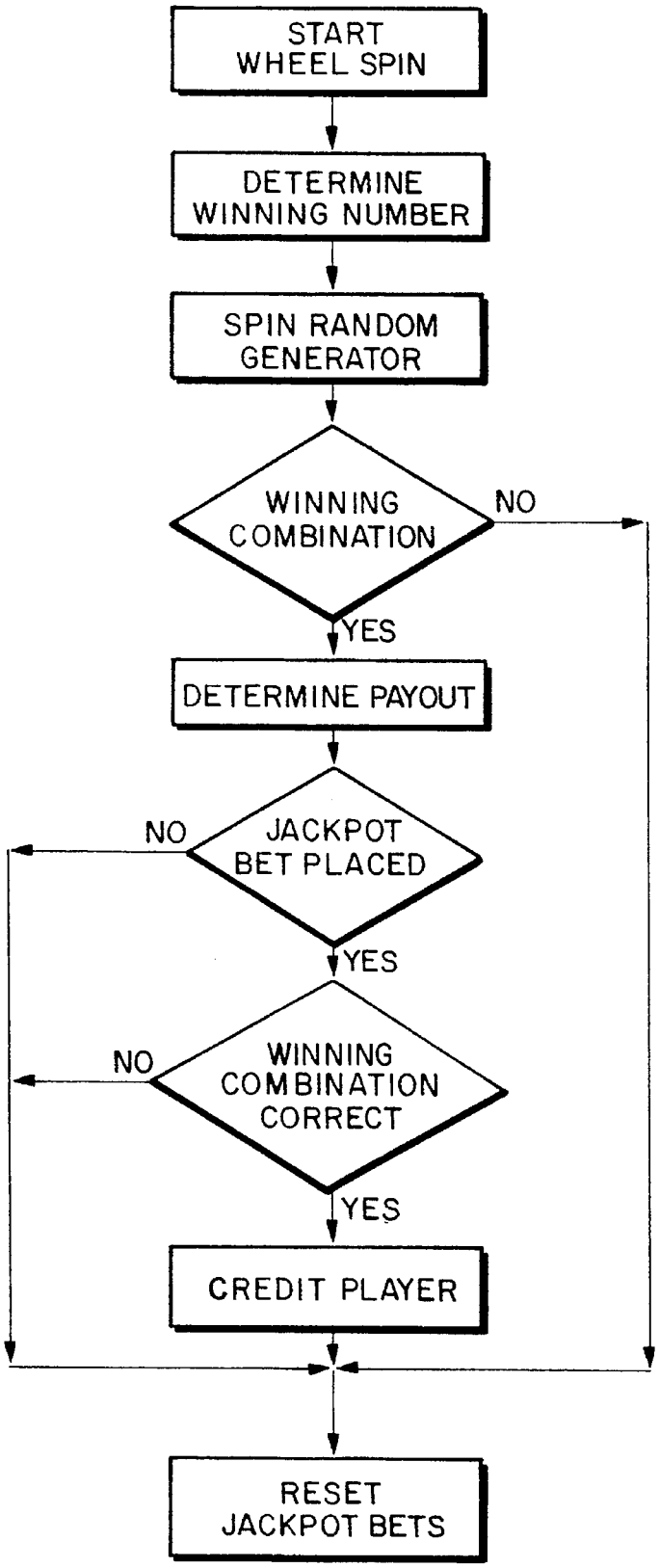
FIG. 5 is a schematic block diagram illustrating the processing and controlling of the jackpot portion of the invention.

Reference is now made to FIGS. 4, 5 and 6. FIG. 4 is a schematic block diagram illustrating the processing and controlling of the roulette game portion of the invention. FIG. 5 is a schematic block diagram illustrating the processing and controlling of the jackpot portion of the invention. FIG. 6 is a schematic block diagram illustrating the processing and controlling of the interactive ball release mechanism of the roulette game. These can each be accomplished by means of any known type of microprocessor and will not be discussed at length herein since it comes well within the knowledge of those skilled in the art.

The present invention has been described and illustrated in what is considered to be preferred and practical embodiments thereof, and the scope of the invention is not to be limited except as set forth in the following claims and within the doctrine of equivalents.

Now that the invention has been described,

What is claimed is:

1. An automated roulette device having an annular ball track and a centrally disposed rotatable wheel with a plurality of ball receptor zones about a periphery thereof, and a ball adapted for travel about the ball track and subsequent receipt, by chance, within any of said ball receptor zones to determine a winning outcome of each spin of the roulette wheel, said device comprising:

wheel control means for controlling actuation and a speed of rotation of the roulette wheel, said wheel control means being structured to allow the roulette wheel to slow after actuating rotation thereof, until said roulette wheel comes to a rest, a ball launching mechanism for launching the ball into the ball track after actuation of rotation of said roulette wheel, detection means for continuously monitoring and visually indicating the location of the ball relative to each of the ball receptor zones as the ball travels about the ball track until coming to rest within one of the ball receptor zones, a processor interconnected to the roulette wheel, said wheel control means, said ball launching mechanism and said detection means for operating said wheel control means and receiving input from said detection means and determining the winning outcome of each spin of the roulette wheel, play display means interconnected with said processor for visually indicating the winning outcome of each spin of the roulette wheel, at least one player console interconnected to said processor for entering wagers on the winning outcome of each spin of the roulette wheel and comprising:

cash input means for reception of money therein, and translation thereof by said processor into units of wagering credit, credit display means for displaying current wagering credit available for entering wagers, bet input means for inputting said wagers to be received by said processor, bet display means for displaying said input wagers, ball launch control means for allowing player control of time of release of the ball by said ball launching mechanism into said annular ball track and for further allowing player control of the velocity of the ball at its release by said ball launching mechanism, cash-out means for terminating player participation and printing credit receipts to indicate a remaining amount of said current wagering credit available at the time of termination of play, and said processor being structured to compare said input wagers with said winning outcome to determine an amount of wagering credit units to add or subtract from said current wagering credit available.

2. The automated roulette device of claim 1 further comprising bet gate means for determining and indicating when wagers may be input based upon predetermined criteria.

3. The automated roulette device of claim 2 further comprising:

jackpot bet means for entering bets on a jackpot in addition to said input wagers on said winning outcome of said roulette wheel spin, and including:

a jackpot generator for randomly generating a series of displayed elements for each of said spins of said roulette wheel, means for entering a jackpot bet from said available wagering credit, wherein said processor compares said series of displayed elements to predetermined parameters to determine winning jackpot bets, said processor being structured to add or subtract said units of wagering credit to said current credit available based on corresponding winning or losing jackpot bets.

4. The automated roulette device of claim 3 wherein said cash input means further comprises a bill validator.

5. The automated roulette device of claim 4 wherein said bet input means comprises:

a panel having a plurality of keys including:

a plurality of betting keys, each of said betting keys representing one of a plurality of wager input selections or combinations, wherein each depression of any of said betting keys results in an input of a single wager of a predetermined amount of said units on the particular wager input selection or combination represented by said depressed betting key, and a reset key for canceling input bets.

6. The automated roulette device of claim 5 wherein said bet display means includes a panel resembling said bet input means panel and comprising a plurality of betting displays, each of said betting displays representing one of said wager input selections and combinations, and said units wagered being indicated on a betting display corresponding with a wager input selection or combination entered on said bet input means panel.

7. The automated roulette device of claim 6 further comprising a units display for displaying the value, in said units, of each of said input wagers.

8. The automated roulette device of claim 7 wherein said cash-out means comprises:

a printer for printing said credit receipts in the amount of said current available credit; and a cash-out key, wherein depressing said cash-out key terminates player participation, activates said printer, and zeroes the credit available.

9. The automated roulette device of claim 8 further comprising sensors on said roulette wheel and interconnected to said processor for monitoring the speed of said ball when in play.

10. The automated roulette device of claim 9 wherein said bet gate means is structured to allow said wagers to be input only when said sensors indicate that said ball is in play and traveling above a predetermined speed.

11. The automated roulette device of claim 10 wherein said wheel control means is controlled randomly within predetermined parameters by said processor, and wherein said ball launch control means comprises:

a plurality of speed selection buttons, wherein depressing one of said selection buttons determines said ball's relative velocity at its release into said annular ball track, a release button, wherein depressing said release button initiates the release of said ball from said ball launching mechanism, and an automatic release mechanism for initiating the release of said ball from said ball launching mechanism after a predetermined time period during which said release button is not depressed.

12. The automated roulette device of claim 11 wherein said play display means comprises a table having a plurality of indicator lights corresponding to individual ones of said ball receptor zones, wherein each of said indicator lights illuminates when said ball is adjacent its corresponding ball receptor zone, and wherein one of said indicator lights flashes when said ball settles into a corresponding ball receptor zone.

13. The automated roulette device of claim 12 further comprising an automatic ball return mechanism for resetting said ball for release by said ball launching mechanism at the completion of each spin of the roulette wheel.

14. An automated roulette device having a rotatable roulette wheel with a plurality of ball receptor zones about a periphery thereof wherein a ball launched into said wheel is adapted to settle into one of said ball receptor zones to determine a winning outcome of each spin of the roulette wheel, said device comprising:

wheel control means for controlling actuation and a speed of rotation of the roulette wheel, said wheel control means being structured to allow the roulette wheel to slow after actuating rotation thereof, until said roulette wheel comes to a rest, a ball launching mechanism for launching the ball into the ball track after actuation of rotation of said roulette wheel, a jackpot generator for randomly generating a series of displayed elements during each spin of the roulette wheel, a processor interconnected to the roulette wheel, said ball launching mechanism and said jackpot generator, said processor being structured to receive input data corresponding with the winning outcome of each spin of the roulette wheel and the randomly generated elements of said jackpot generator, at least one player console interconnected to said processor for entering wagers on the winning outcome of each spin of the roulette wheel and a progressive jackpot corresponding with the randomly generated elements, said player console comprising:

cash input means for reception of money therein, and translation thereof by said processor into units of wagering credit, credit display means for displaying current wagering credit available for entering wagers, bet input means for inputting said wagers to be received by said processor, ball launch control means for allowing playing control of time of release of the ball by said ball launching mechanism and for further allowing player control of the velocity of the ball at its release by said ball launching mechanism, and cash-out for terminating player participation and printing credit receipts to indicate a remaining amount of said wagering credit available at the time of termination of play, and said processor being structured to compare said input wagers on the outcome of each spin of the roulette wheel with said winning outcome to determine an amount of wagering credit units to add or subtract from said available wagering credit, and said processor further being structured to compare said input bets on said progressive jackpot with said generated elements and other predetermined criteria to determine a payout of a jackpot prize to be credited to said wagering credit available.

15. An automated roulette device having an annular ball track and a centrally disposed rotatable wheel with a plurality of ball receptor zones about a periphery thereof, and a ball adapted for travel about the ball track and subsequent receipt, by chance, within any of said ball receptor zones to determine a winning outcome of each spin of the roulette wheel, said device comprising:

wheel control means for controlling actuation and a speed of rotation of the roulette wheel, said wheel control means being structured to allow the roulette wheel to slow after actuating rotation thereof, until said roulette wheel comes to a rest, a ball launching mechanism for launching the ball into the ball track after actuation of rotation of said roulette wheel, detection means for continuously monitoring and visually indicating the location of the ball relative to each of the ball receptor zones as the ball travels about the ball track until coming to rest within one of the ball receptor zones, a processor interconnected to the roulette wheel, said wheel control means, said ball launching mechanism and said detection means for operating said wheel control means and receiving input from said detection means and determining the winning outcome of each spin of the roulette wheel, play display means interconnected with said processor for visually indicating the winning outcome of each spin of the roulette wheel, at least one player console interconnected to said processor for entering wagers on the winning outcome of each spin of the roulette wheel and comprising:

cash input means for reception of money therein, and translation thereof by said processor into units of wagering credit, credit display means for displaying current wagering credit available for entering wagers, bet input means for inputting said wagers to be received by said processor, bet display means for displaying said input wagers, cash-out means for terminating player participation and printing credit receipts to indicate a remaining amount of said current wagering credit available at the time of termination of play, and said processor being structured to compare said input wagers with said winning outcome to determine an amount of wagering credit units to add or subtract from said current wagering credit available.

* * * * *